United States Patent [19]

Bristow et al.

[11] 4,340,337

[45] Jul. 20, 1982

[54] POSITIVE DISPLACEMENT PUMP SYSTEMS

[75] Inventors: Ian T. Bristow, Higham; Nigel J. Petts, Rochester, both of England

[73] Assignee: Hobourn-Eaton Limited, Kent, England

[21] Appl. No.: 101,790

[22] Filed: Dec. 10, 1979

[30] Foreign Application Priority Data

Dec. 13, 1978 [GB] United Kingdom ..... 48268/78

[51] Int. Cl.[3] ..... F04B 49/02; F04B 49/08

[52] U.S. Cl. ..... 417/304; 417/308

[58] Field of Search ..... 417/286, 288, 300, 302, 417/304, 308

[56] References Cited

U.S. PATENT DOCUMENTS

| | | | |
|---|---|---|---|
| 2,755,741 | 7/1956 | Erskine | 417/304 X |
| 3,384,020 | 5/1968 | Searle | 417/300 |
| 3,985,472 | 10/1976 | Virtue et al. | 417/286 X |

*Primary Examiner*—Richard E. Gluck

*Attorney, Agent, or Firm*—Wenderoth, Lind & Ponack

[57] ABSTRACT

A positive displacement pump system has first and second delivery passages for the pumped fluid and a main discharge passage. A control valve operating in dependence on the pressure drop across an orifice in the discharge passage diverts through overspill porting a proportion of the flow through the second delivery passage, the remainder added to the flow from the first delivery passage and passed to the discharge passage. The control valve also regulates the by-passing of a proportion of the flow from the first delivery passage to the overspill porting. As the said pressure drop increases, the control valve first increases the proportion of the flow from the second delivery passage diverted to the overspill porting and, as the pressure drop increases further, then commences to by-pass fluid from the first delivery passage to the overspill port, the quantity by-passed increasing with increase of said pressure drop. For a given movement of the valve member, the increase of effective area of communication between the second delivery passage and the overspill porting is greater than that between the first delivery passage and the overspill porting.

3 Claims, 3 Drawing Figures

POSITIVE DISPLACEMENT PUMP SYSTEMS

This invention relates to positive displacement pump systems.

According to this invention there is provided a positive displacement pump system having first and second delivery passages for pumped fluid, a main discharge passage connected to receive fluid from the first delivery passage and having a discharge orifice disposed therein, overspill porting, and a control valve for apportioning the flow from the second delivery passage between the first delivery passage and the overspill porting and controlling the by-passing of a proportion of the flow from the first delivery passage to the overspill duct, said control valve comprising a valve body having the overspill porting therein and a spring-loaded valve member adapted and arranged for movement against the spring force in dependence on the pressure drop across said discharge orifice, said valve member having a transfer passage for transferring fluid from the second to the first delivery passage and having passage means therein for respectively placing the first and second delivery passages in communication with the overspill porting, the arrangement of the passage means and the porting being such that as said pressure drop increases an increasing proportion of the fluid from the second delivery passage is passed to the overspill porting and that as said pressure drop increases further an increasing proportion of the fluid from the first delivery passage is passed to the overspill porting.

In preferred embodiments of the invention the valve body provides a valve bore and a valve member axially slidably mounted in the valve bore, one end of the valve bore communicating with a chamber to which the first delivery passage and the main discharge passage open, the valve member having a central passage opening at one end to the second delivery passage and at the other end to said chamber, and said valve member having two axially-spaced lands on its external surface with a recess therebetween constituting said passage means one of which lands isolates said one end of the central passage from the recess and regulates the communication between the second delivery passage and the overspill porting and the second of which lands regulates communication between said chamber and the overspill porting.

Preferably the increase in the area of communication between the second delivery passage and the overspill porting for a given axial movement of the valve member with increase of said pressure drop is greater than the increase of area of communication between said chamber and the overspill porting.

Figure 1:
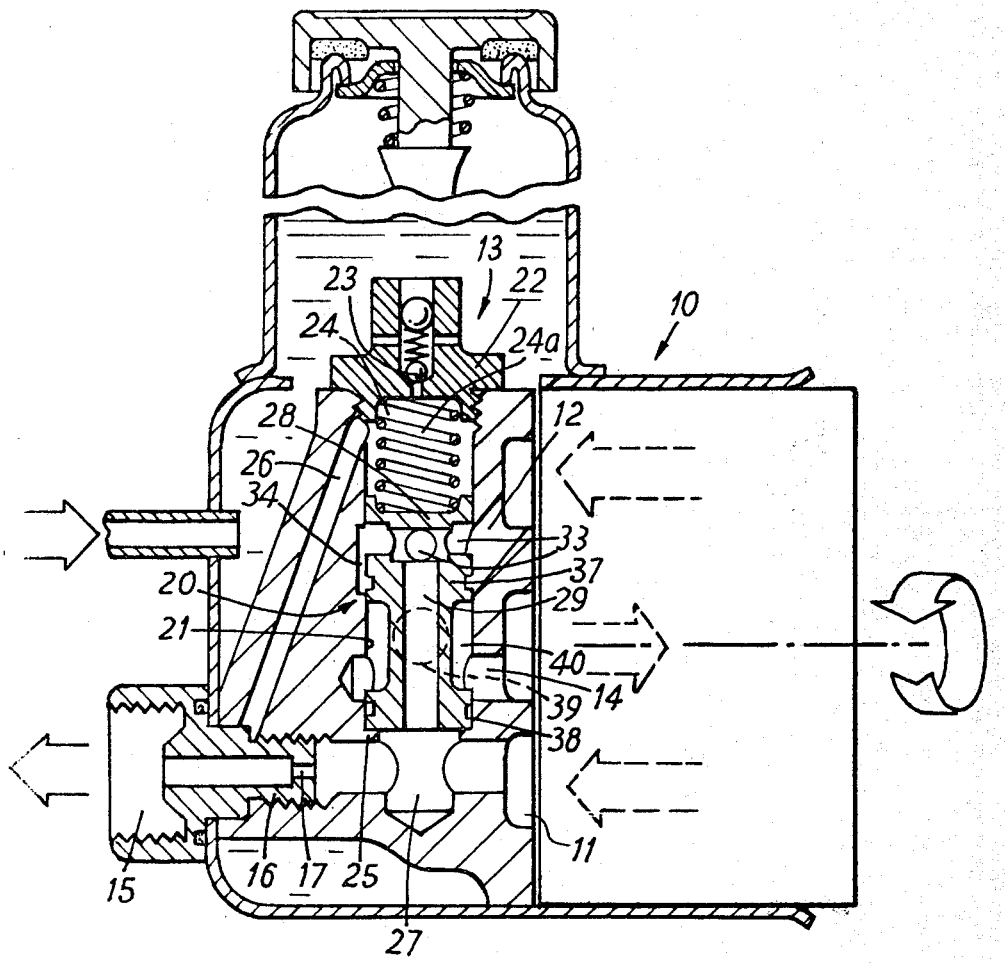
Figure 2:
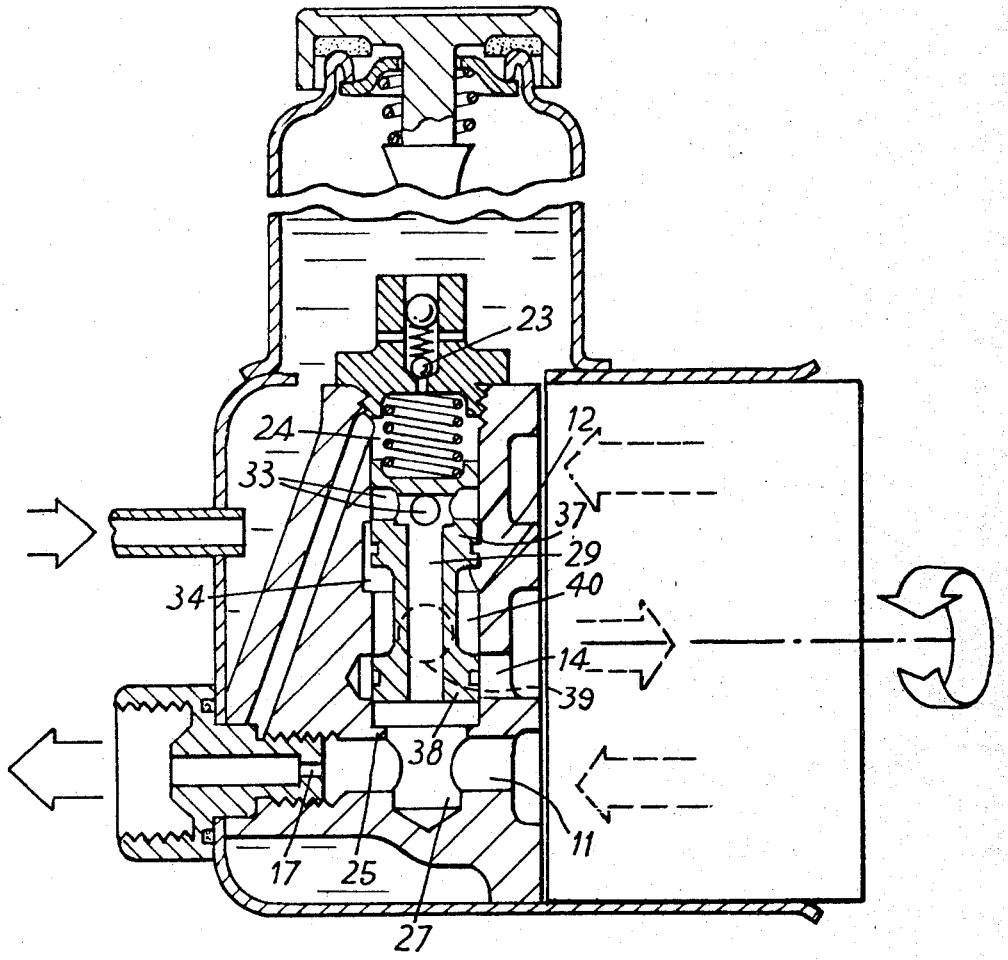
Figure 3:
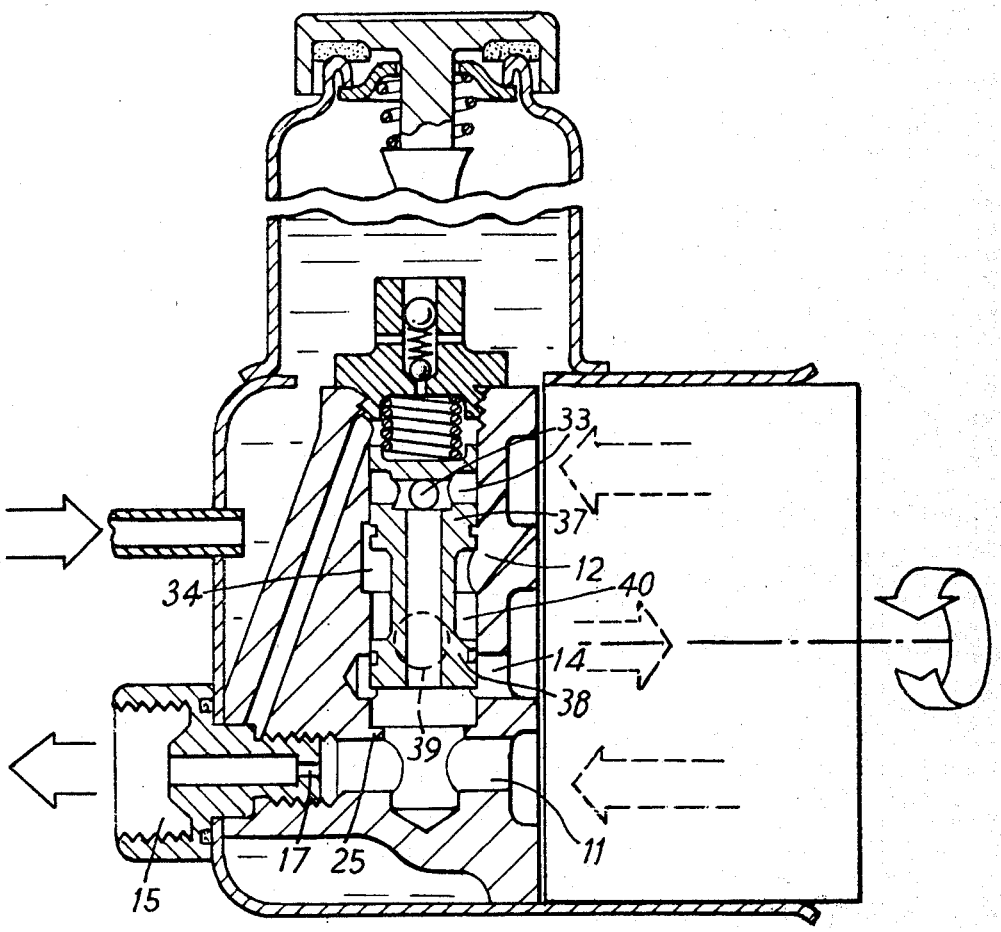

One embodiment of the invention will now be described by way of example with reference to the accompanying diagrammatic drawings in which:

FIGS. 1 to 3 respectively show a positive displacement pump system according to the invention with its control valve in three positions of operation.

Referring to the drawings, the form of the positive displacement pumping mechanism indicated generally at 10 is not material to the invention but the pump is required to deliver pressure fluid to first and second delivery passages 11, 12 which are in communication with each other only under the control of a control valve 13. The combined flow from passages 11 and 12, less any which is surplus to the immediate requirements of the external circuit and which is directed to an overspill port 14 in the valve and thence to a fluid reservoir or the pump inlet for recirculation, is delivered to the external circuit through a main discharge passage 15 in which is mounted a threaded plug 16 having a discharge control orifice 17 therein. The orifice is of accurately predetermined diameter according to the required fluid delivery, and the pressure drop across the orifice is applied to the valve 13 to maintain the flow through the orifice substantially constant. Such a pump may supply pressure servo-fluid, for example to the open-centre servo valve of a servo-assisted vehicle steering mechanism.

Referring now to FIG. 1, the valve 13 comprises a valve member 20 slidably mounted in a valve bore 21. The upper end of the valve bore has screwed into it a plug 22 carrying a spring-loaded bail relief valve 23 through which fluid under excess pressure in a chamber 24 formed at the upper end of the bore can be discharged into the encompassing fluid reservoir 18. Chamber 24 contains a spring **24*a* which urges the valve member 20 downward into abutment with an annular shoulder 25 at the other end of the valve bore. Chamber 24 communicates through a bore 26 with the main discharge passage 15 at a location downstream of the orifice 17**.

The lowr end of the valve bore opens through an aperture bounded by the shoulder 25 to a chamber 27 which is formed by a smaller-diameter extension of the valve bore, and which places the first delivery passage 11 in permanently open communication with the main discharge passage 15. The pressure at the upstream side of the orifice 17 is thus applied in chamber 27 to the lower end of the valve member, the pressure at the downstream side of the orifice being applied in chamber 24 to the other end of the valve member.

The upper end portion 28 of the valve member blocks off communication between the second delivery passage 12 and the spring chamber 24. From below the portion 28 the valve member has a central axial bore 29 the lower end of which opens to the chamber 27. The upper end of the bore 29 communicates with the second delivery passage 12 through two cross-bores 33. The diameter of the valve bore 21 is slightly greater where the passage 12 opens to the bore, forming an annular chamber 34 about the valve member.

An annular groove on the external surface of the valve member forms lands 37, 38 respectively above and below it. The overspill port 14 and an auxiliary overspill port 39 in the wall of the valve bore, both of which ports communicate with a main overspill passage (not shown), open to the annular space 40 formed by the groove. Auxiliary port 39 ensures that space 40 has an adequate area of communication with the overspill passage in all positions of the valve member. When the valve member is in its initial position against the shoulder 25, lands 37 and 38 respectively close off communication between delivery passage 12 and chamber 27 on the one hand and the overspill ports 14, 39 on the other.

At low pressure and low pump speed the flow from passage 12 flows through cross-bores 33 and bore 29 into chamber 27 to join the flow from passage 11 through the main discharge passage 15, the valve member being held against the shoulder 25 by the spring **24*a***.

As the pump speed increases, the total delivery of the pump increases but the demands of the external circuit can be met to an increasing degree by the delivery through passage 11. The increased flow through the discharge orifice 17 produces an increased pressure drop which is applied to the valve member and causes the valve member to move against the force of spring 24*a*, and the bottom edge of the land 37 commences to open communication between passage 12 and the overspill space 40 via chamber 34. As the pump speed continues to increase, the area of communication between chamber 34 and space 40 increases further whilst the area of communication between passage 12 and the cross-bores 33 decreases until eventually all of the fluid from passage 12 is being discharged through the overspill, communication between passage 12 and the cross-bores 33 being blanked off by land 37, as shown in FIG. 2. As the pump speed increases further, the lower edge of land 38 begins to uncover the lower edge of overspill port 14 as shown in FIG. 3, allowing an increasing proportion of the fluid delivered through the delivery passage 11 to chamber 27 to be passed to the main overspill passage, so that the flow control exercised by the valve takes place on the flow from delivery passage 11. At the same time, the area of communication between passage 12 and space 40 via chamber 34 continues to increase, so that the pressure in the delivery passage 11 and hence the powr absorbed by the pump in pumping fluid into this passage is less than it would otherwise be. It should be noted that each movement of the valve member in a direction to increase the overspill produces a greater increase in the area of communication between passage 12 and space 40 via chamber 34 than between chamber 27 and port 14, because the former area is an annular area whilst the latter area is only a port in the wall of the valve bore. However, a similar result could be achieved even if the former area also were part of a port in the wall of the valve bore.

The area of the auxiliary port 39 is sufficiently great to enable it to pass, without substantial restrictive effect, the entire flow from port 12 to overspill in all positions of the valve member in its working range and at all speeds in the design range of the pump.

If the pressure of the fluid exceeds a predetermined safe level, the pressure in the spring chamber 24 causes the pilot relief valve 23 to open. Fluid then flows from chamber 24 into the reservoir and there is a substantial drop in pressure in this chamber, causing the valve member to move upward to increase sharply the amount of fluid being passed to the overspill ports 14 and 39.

It will be understood that the invention is equally applicable where the valve is in the form of a rotatable valve member co-operating with a port plate.

We claim:

1. A positive displacement pump system having first and second delivery passages for pumped fluid, a main discharge passage connected to receive fluid from the first delivery passage and having a discharge orifice disposed therein, overspill porting, and a control valve for apportioning the flow from the second delivery passage between the first delivery passage and the overspill porting and controlling the by-passing of a proportion of the flow from the first delivery passage to the overspill porting, said control valve comprising a valve body having the overspill porting therein and a spring-loaded valve member adapted and arranged for movement against the spring force in dependence on the pressure drop across said discharge orifice, said valve member having a transfer passage for transferring fluid from the second to the first delivery passage and having passage means therein for respectively placing the first and second delivery passages in communication with the overspill porting, the passage means and the porting being positioned relative to each other for being opened to said second delivery passage as said pressure drop increases for causing an increasing proportion of the fluid from the second delivery passage to be passed to the overspill porting and as said pressure drop increases further, for being opened to said first delivery passage for causing an increasing proportion of the fluid from the first delivery passage to be passed to the overspill porting.

2. A pump system as claimed in claim 1, wherein the valve body has a valve bore therein, said valve member being axially slidably mounted in the valve bore, one end of the valve bore communicating with the chamber to which the first delivery passage and the main discharge passage open, the valve member having a central passage opening at one end to the second delivery passage and at the other end to said chamber, and said valve member having two axially-spaced lands on its external surface with a recess therebetween constituting said passing means one of which lands isolates said one end of the central passage from the recess and regulates the communication between the second delivery passage and the overspill porting and the second of which lands regulates communication between said chamber and the overspill porting.

3. A pump system as claimed in claim 2, wherein the increase in the area of communication between the second delivery passage and the overspill porting for a given axial movement of the valve member with increase of said pressure drop is greater than the increase of area of communication between said chamber and the overspill porting.

* * * * *